US006918942B2

(12) United States Patent
Hatta et al.

(10) Patent No.: US 6,918,942 B2
(45) Date of Patent: Jul. 19, 2005

(54) PROCESS FOR PRODUCTION OF TITANIUM ALLOY

(75) Inventors: Yoshihiro Hatta, Chigasaki (JP); Toshihiko Sakai, Chigasaki (JP); Takeshi Shiraki, Chigasaki (JP); Takeshi Sannohe, Chigasaki (JP); Osamu Tada, Chigasaki (JP)

(73) Assignee: Toho Titanium Co., Ltd., Chigasaki (JP)

( * ) Notice: Subject to any disclaimer, the term of this patent is extended or adjusted under 35 U.S.C. 154(b) by 54 days.

(21) Appl. No.: 10/455,385

(22) Filed: Jun. 6, 2003

(65) Prior Publication Data

US 2003/0226624 A1 Dec. 11, 2003

(30) Foreign Application Priority Data

Jun. 7, 2002 (JP) ..... 2002-166581
Apr. 17, 2003 (JP) ..... 2003-113171
Apr. 24, 2003 (JP) ..... 2003-119860

(51) Int. Cl.[7] ..... C22B 4/06

(52) U.S. Cl. ..... 75/10.13; 75/10.65; 420/418; 420/590

(58) Field of Search ..... 75/103.13, 10.65; 420/418, 590

(56) References Cited

U.S. PATENT DOCUMENTS 4,108,644 A * 8/1978 Walberg et al. ..... 75/10.26
4,794,979 A * 1/1989 Gassner et al. ..... 164/495
6,004,368 A * 12/1999 Chandley et al. ..... 75/10.14

FOREIGN PATENT DOCUMENTS

JP 04-158955 A 6/1992

* cited by examiner

*Primary Examiner*—Melvyn Andrews
(74) *Attorney, Agent, or Firm*—Antonelli, Terry, Stout & Kraus, LLP

(57) ABSTRACT

Titanium-aluminum alloy is prepared as a master alloy, and the aluminum master alloy and a pure titanium material are melted by an electron beam to yield titanium alloy.

14 Claims, No Drawings

PROCESS FOR PRODUCTION OF TITANIUM ALLOY

BACKGROUND OF THE INVENTION

1. Technical Field

The present invention relates to a process for production of titanium alloy, and in particular, relates to a process for production of Ti—Al alloy using an intermetallic compound of titanium-aluminum.

2. Background Art

Recently, titanium materials have been used not only for airplanes but also for general uses. In particular, titanium alloys are widely used in fields in which corrosion resistance or weight reduction is required.

However, titanium alloys are not widely used because they are expensive compared to other materials. In particular, although Ti-6 wt % Al-4 wt % V alloy exhibits superior strength and corrosion resistance, it has not found wide consumer use due to its high cost.

In Japanese Unexamined Patent Application Publication No. 158955/92, a technique in which Ti-6 wt % Al-4 wt % V alloy having a low level impurities is produced at low cost by adding an excess amount of pure Al with respect to the desired composition to titanium alloy scrap containing Al and melting the material by EB (electron beam) melting is disclosed. However, in this technique, since an excess amount of Al is added due to vaporization of Al in the EB melting process, the amount of vaporized Al varies and control of the alloy composition is difficult. Furthermore, since Al is added in controlling the Al content, pure Al as a raw material must be formed into briquettes to weigh the amount of added Al, whereby producing cost may be increased.

In addition, demand for titanium material for a target is recently increasing as electric materials are widely used. However, efficient recycling methods for spent target material are unknown.

SUMMARY OF THE INVENTION

Therefore, the present invention was completed in view of the situation explained above. An object of the invention is to provide a process for production of Ti—Al alloy, which is inexpensive and reliable in quality.

The inventors have researched to solve the problems described above, and they have found that inexpensive Ti—Al alloy having low component variation can be produced by using titanium-aluminum alloy as a master alloy of the aluminum component, and melting the material in an EB furnace. The present invention is completed based on the above knowledge.

That is, the present invention provides a process for production of titanium alloy comprising the steps of preparing titanium-aluminum alloy as a master alloy, and melting this aluminum master alloy and pure titanium material by an electron beam to obtain titanium alloy.

In the process for production mentioned above, since titanium-aluminum alloy having low vapor pressure is used as the master alloy of the aluminum component, variation of aluminum content in the titanium alloy obtained by electron beam melting is low, and the content can be reliable. Furthermore, since titanium-aluminum alloy can be relatively easy to obtain as scrap of titanium alloy containing high Al, producing cost can be reduced.

Preferable embodiments of the present invention are explained below. Titanium-aluminum alloy is defined by a formula $Ti_xAl$, and sufficient effects can be exhibited in the case in which x is in a range of from ⅓ to 3 in the present invention. In the case in which excess amount of Al with respect to the above range is contained, Al loss during melting is extreme and undesirable from the viewpoint of composition control and yield efficiency. On the other hand, in the case in which Al is contained in an amount below the range, desired Ti-6Al-4V alloy composition cannot be maintained, and metal Al must be supplied. In this case, vaporizing loss of Al in the melting is also extreme and undesirable from the viewpoint of composition control.

Therefore, it is desirable that titanium-aluminum alloy having a composition within the range be used as the aluminum source.

Alternatively, in the present invention, among titanium-aluminum alloys, a titanium-aluminum intermetallic compound can be used. $Ti_3Al$, TiAl, $TiAl_2$, $TiAl_3$ or the like can be used as the intermetallic compound. In particular, among these intermetallic compounds, $Ti_3Al$ and TiAl can reduce vaporizing loss in the melting because of their high vapor pressure.

It should be noted that not only can a single intermetallic compound be used, but also a mixture of intermetallic compounds can be used as the aluminum source.

In addition, intermetallic compounds having compositions other than $Ti_3Al$, TiAl, $TiAl_2$, $TiAl_3$ can be used.

As a preferable example of a titanium alloy of the present invention, Ti—Al—V alloy, for example, Ti-6Al-4V, may be mentioned. Furthermore, the invention can be widely applied to alloys in which Al or V is contained as a main component, for example Ti-10V-2Fe-3Al alloy, Ti-6Al-2Zr-4Mo-2Sn alloy, Ti-4.5Al-3V-2Fe-2Mo alloy or the like.

Pure Titanium Material

As a pure titanium material as a melting raw material, sponge titanium lumps produced by the Kroll process can be used as a main raw material. The present invention is not limited to the titanium sponge by the Kroll process and pure titanium scrap which is generally available also can be used.

As scrap, for example, black scales which are produced in grinding a surface portion of a slab of by melting an ingot produced from an A-class sponge titanium, white scales (also called "turnings") which are produced in a sizing after forging thereof, cut pieces (also called "chips") which are produced in working of a rolled plate or bar or wire can be used.

The pure titanium material which is used as a melting raw material preferably contains 0.01 to 0.3 wt % of Fe, 0.003 to 0.03 wt % of N, 0.01 to 0.40 wt % of O, other inevitable components, and the balance of Ti. The inevitable components may be not more than 0.05 wt % of Cr and Ni each, not more than 0.020 wt % of C, and not more than 100 ppm of H, or the like.

The form of the pure titanium material described above may be a plate, bar, wire, or other form, and is not limited as long as the compositions are within the ranges described above. However, the raw material is preferably formed into a shape in which it is easy to form briquettes. Specifically, the pure titanium material may preferably be crushed or cut into pieces having lengths of several centimeters.

Aluminum Master Alloy

As disclosed in Japanese Unexamined Patent Application Publication No. 158955/92 described above, metal aluminum was supplied alone to an EB melting furnace as the aluminum alloy component conventionally. However, vaporizing loss of aluminum was substantial because of its high vapor pressure. In contrast, in the present invention, since the aluminum component is added in conditions of alloy with titanium, vaporizing loss is low. As the aluminum component, commercial products of alloy of titanium and aluminum can be used, and scrap materials of alloy of titanium-aluminum can be also used.

As scrap material which is generally available, Ti-6 wt % Al-4wt % V based materials are mainly used. In recent years, high-aluminum alloy based scraps such as the intermetallic compound of Ti-17 wt % Al or Ti-36 wt % Al can be used as scraps of titanium material for targets. These alloys are preferable for EB melting because vapor pressure of melting aluminum component is low. In addition, these alloys are hard and brittle due to high aluminum content. Therefore, crushing and granulating process can be relatively easily performed to control the size appropriate for melting.

Furthermore, the vapor pressure of these alloys is extremely low compared to metal aluminum, and vaporizing loss of aluminum can be greatly reduced. Therefore, variation of aluminum component in an ingot or variation of aluminum components among ingots can be reduced.

Melting Material for V

V for an alloy component has lower vapor pressure compared to Al, and vaporizing loss in EB melting will rarely be a problem. However, the melting point of V is 1890° C., which is higher than the melting point of titanium, and it is effective to be added in conditions of the master alloy.

As a master alloy of V, 35 wt % Al-65 wt % V alloy or 50 wt % Al-50wt % V alloy can be used, and alloys having desired composition can be produced by adding predetermined amounts of such V master alloy. However, it is desirable that slightly more V be added than the desired value because vaporizing loss of V is not zero.

Melting and Casting for Titanium Ingot

After the raw material described above is prepared to have predetermined components, melting processes can be performed by using EB melting furnace. The raw material for melting can be melted after being formed into briquettes, or can be supplied as it is. The condition of the raw material is preferably chips rather than briquettes when Ti—Al alloy are used.

On the other hand, when generally available scraps are processed as a titanium-aluminum alloy, the scrap is preferably crushed and granulated into predetermined size to be supplied. The ingot component and grain size after melting can be uniform by performing such preliminary treatment. Specifically, it is desirable to be granulated in a range of from 4 to 20 mm.

There are drip melting methods and hearth melting methods in EB melting. The drip melting method is a method in which raw material is crushed and granulated into predetermined size and formed into briquettes; an electron beam is irradiated to an end portion of the briquette to melt it; and the melted portion is dripped into a water-cooled mold and solidified to obtain a titanium ingot. In this method, a process in which the melted raw material is formed into briquettes beforehand is required.

On the other hand, in the hearth melting method mentioned above, a flat water-cooled copper mold called a hearth is provided before the water-cooled mold described above, the melting raw material is supplied to an upper space of the hearth while the electron beam is irradiated to melt the raw material, and the melted material is dripped into the hearth mentioned above. A melted titanium bath is formed in the hearth, and this bath is forming a flow toward the water-cooled mold. HDIs (high density inclusions) contained in the raw material are settled and separated to a bottom portion of the hearth while the melted raw material is flowing in the titanium bath, whereby only clean titanium bath flows into the water-cooled mold.

As explained above, melting pools must be maintained in both of the hearth and the mold, electric power cost tends to be higher compared to the case of a drip melting method. However, pretreatment such as briquette forming is not required in the hearth melting, granular raw material can be used, and ingots of high quality can be obtained.

Both melting methods can be performed in the present invention, and the method can be selected according to the application of an ingot. For example, in the case in which extremely high quality and characteristics are not required in ingots, both the drip melting and the hearth melting may be used. However, in the case in which requirements for ingot are strict, for example, in the case in which inclusions such as HDIs must not be contained, such inclusion can be effectively removed by performing the hearth melting.

EXAMPLES

The present invention is further explained in detail by way of Examples.

Example 1

965 kg of sponge titanium corresponding to Japanese Industrial Standard 1, 2800 kg of Ti-6 wt % Al-4 wt % V alloy scrap, 75 kg of 35 wt % Al-65 wt % V alloy were prepared, and Ti-36 wt % Al alloy scrap of intermetallic compound was used as the master alloy of aluminum.

Then, these materials were charged into an EB furnace of the hearth type and were melted in conditions as mentioned below, and Ti-6 wt % Al-4 wt % V alloy was obtained. Compositions of each raw material before melting are shown in Tables 1 to 4.

1) Composition of Raw Material

1. Titanium raw material: Sponge titanium corresponding to Japanese Industrial Standard 1

TABLE 1

| | Chemical composition | | |
|---|---|---|---|
| | Fe | O | N |
| Analyzed value (wt %) | 0.034 | 0.043 | 0.005 |

2. 6Al4V alloy raw material: Ti-6 wt % Al-4 wt % V alloy scrap

TABLE 2

| | Chemical composition | | | |
|---|---|---|---|---|
| | Al | V | Fe | O |
| Analyzed value (wt %) | 6.20 | 4.15 | 0.15 | 0.20 |

3. Raw material for Al: Ti-36 wt % Al alloy scrap

TABLE 3

| | Chemical composition | | |
|---|---|---|---|
| | Al | Fe | O |
| Analyzed value (wt %) | 36.0 | 0.10 | 0.20 |

4. Raw material for V: 35 wt % Al-65 wt % V alloy

TABLE 4

| | Chemical composition | | | |
|---|---|---|---|---|
| | Al | V | Fe | O |
| Analyzed value (wt %) | 32.0 | 67.0 | 0.26 | 0.15 |

2) Melting Condition

Degree of vacuum: $1\times10^{-3}$ to $5\times10^{-4}$ Torr

3) Result of Melting

The compositions of the titanium alloy obtained by the method described above are shown in Table 5. As is obvious from Table 5, the Al component of each titanium alloy is close to the desired value, furthermore, variation among ingots is small.

TABLE 5

| | Analyzed value | | | |
|---|---|---|---|---|
| Melting No. | Al | V | Fe | O |
| Desired value | 6.20 | 4.15 | — | — |
| 1 | 6.20 | 4.15 | 0.15 | 0.13 |
| 2 | 6.18 | 4.16 | 0.14 | 0.15 |
| 3 | 6.22 | 4.14 | 0.16 | 0.14 |

Comparative Example 1

1068 kg of sponge titanium corresponding to JIS 1 used in Example 1, 2880 kg of Ti-6 wt % Al-4 wt % V alloy scrap, 75 kg of 35 wt % Al-65 wt % V alloy scrap, and 57 kg of metal Al shot were prepared, these materials were charged into an EB melting furnace of the hearth type, and Ti-6 wt % Al-4 wt % V alloy was obtained with the same apparatus and melting conditions as in Example 1. The analyzed value of titanium alloy ingot obtained by melting is shown in Table 6.

TABLE 6

| Melting No. | Al | V | Fe | O |
|---|---|---|---|---|
| Desired value | 6.20 | 4.15 | — | — |
| 1 | 6.00 | 4.15 | 0.14 | 0.14 |
| 2 | 6.10 | 4.18 | 0.13 | 0.12 |

As is obvious from Table 6, vaporizing loss in the melting of aluminum is great because the metal Al shot was used as aluminum raw material in the Comparative Example. Therefore, the desired amount of aluminum could not be obtained. Furthermore, the amount of aluminum in each titanium alloy varied.

As explained above, Ti—Al alloy which is inexpensive and reliable in quality can be produced because titanium-aluminum alloy is prepared as a master alloy and this aluminum master alloy and pure titanium material are melted by an electron beam to obtain titanium alloy.

What is claimed is:

1. A process for production of titanium alloy comprising:

preparing a titanium-aluminum alloy as an aluminum master alloy, melting the aluminum master alloy and pure titanium material by electron beam melting to obtain a titanium alloy, wherein the melting is performed without using aluminum metal.

2. The process for production of titanium alloy according to claim 1, wherein the titanium-aluminum alloy is defined by a formula $Ti_xAl$, and x is a real number expressed by ⅓ to 3.

3. The process for production of titanium alloy according to claim 1, wherein the titanium-aluminum alloy is obtained from scrap.

4. The process for production of titanium alloy according to claim 1, wherein the titanium-aluminum alloy is a titanium-aluminum intermetallic compound.

5. The process for production of titanium alloy according to claim 4, wherein the titanium-aluminum intermetal tic compound is $Ti_3Al$, TiAl, $TiAl_2$, or $TiAl_3$.

6. The process for production of titanium alloy according to claim 4, wherein the titanium-aluminum intermetallic compound is obtained from scrap.

7. A process for production of titanium alloy comprising:

preparing a titanium-aluminum alloy as an aluminum master alloy, melting the aluminum master alloy and pure titanium material by electron beam melting to obtain a titanium alloy.

wherein the melting is performed using only the aluminum master alloy and the pure titanium material without using metal aluminum.

8. A process for production of titanium alloy comprising:

preparing a titanium-aluminum alloy as an aluminum master alloy and an aluminum-vanadium alloy as a vanadium master alloy, melting the aluminum master alloy, the vanadium master alloy, and pure titanium material by electron beam melting to obtain a titanium alloy, wherein the melting is performed using only the aluminum master alloy, vanadium master alloy, and the pure titanium material without using metal aluminum.

9. A process for production of titanium alloy comprising:

preparing a titanium-aluminum alloy as an aluminum master alloy; and melting a raw material consisting essentially of the aluminum master alloy, pure titanium material and optionally vanadium or a vanadium alloy by electron beam melting to obtain a titanium alloy.

10. The process for production of titanium alloy according to claim 9, wherein the titanium-aluminum alloy is defined by a formula $Ti_xAl$, and x is a real number expressed by ⅓ to 3.

11. The process for production of titanium alloy according to claim 9, wherein the titanium-aluminum alloy is obtained from scrap.

12. The process for production of titanium alloy according to claim 9, wherein the titanium-aluminum alloy is a titanium-aluminum intermetallic compound.

13. The process for production of titanium alloy according to claim 12, wherein the titanium-aluminum intermetallic compound is $Ti_3Al$, TiAl, $TiAl_2$, or $TiAl_3$.

14. The process for production of titanium alloy according to claim 12, wherein the titanium-aluminum intermetallic compound is obtained from scrap.

* * * * *